United States Patent [19]

Poleri

[11] 4,202,131

[45] May 13, 1980

[54] INTERCONNECTING BUILDING BLOCKS

[76] Inventor: Victor J. Poleri, 207 E. 15th St., New York, N.Y. 10003

[21] Appl. No.: 876,623

[22] Filed: Feb. 10, 1978

[51] Int. Cl.[2] ..... A63H 33/08

[52] U.S. Cl. ..... 46/25

[58] Field of Search ..... 46/24, 23, 16, 25, 26, 46/17, 28; 35/27

[56] References Cited

U.S. PATENT DOCUMENTS

| | | | |
|---|---|---|---|
| 1,894,605 | 1/1933 | Wright | 46/25 |
| 1,898,297 | 2/1933 | Fox | 46/25 |
| 2,020,562 | 11/1935 | Miller | 46/35 |
| 2,247,614 | 7/1941 | Lingenfelter | 46/25 X |
| 2,472,363 | 6/1949 | Blackinton | 46/25 |
| 3,372,936 | 3/1968 | Sanson | 46/28 X |
| 3,678,613 | 7/1972 | Geymeier | 46/25 |
| 3,791,090 | 2/1974 | Kniefel | 52/593 |
| 3,919,785 | 11/1975 | Generaux | 46/25 X |
| 4,007,555 | 2/1977 | Sasaoka | 46/25 |

FOREIGN PATENT DOCUMENTS

| | | | |
|---|---|---|---|
| 2201638 | 7/1973 | Fed. Rep. of Germany | 46/26 |
| 2307241 | 8/1974 | Fed. Rep. of Germany | 46/25 |
| 11293 | of 1910 | United Kingdom | 46/25 |

*Primary Examiner*—John F. Pitrelli

*Attorney, Agent, or Firm*—Amster, Rothstein & Engelberg

[57] ABSTRACT

A toy block unit having a central hub and at least three attachment arms extending outwardly along non-parallel axes projecting from the central hub. At least one of the axes projects out of the plane defined by the other axes. The attachment arms are dimensioned for interconnection with identical arms on adjacent block units, to allow the construction of three-dimensional structures.

5 Claims, 5 Drawing Figures

INTERCONNECTING BUILDING BLOCKS

The invention relates to a new toy and in particular to a building block unit which is capable of being interconnected with similar such blocks to form a wide variety of shapes in three dimensions.

There are a great variety of toy blocks in which an individual block unit is interconnected to form larger structures. Typical of these are the toys disclosed by Blackinton, U.S. Pat. No. 2,472,363; Miller, U.S. Pat. No. 3,020,562; and Sasoaka, U.S. Pat. No. 4,007,555. These blocks and block sets are deficient in that they either require a number of differently shaped pieces for assembly of structures or are limited by the fact that the means for attaching adjacent block units lie along axes which define a single plane.

These deficiencies limit the creativity of the user of the blocks, limit the shapes of structures that can be built by preventing the user from fully utilizing all three dimensions, and increase the cost and complexity of the resulting block set.

It is an object of the present invention to overcome these limitations by providing a block unit which has attachment arms lying along non-parallel axes, thus allowing the user to more fully express his creativity in all three dimensions. A further object of the invention is to provide a novel and improved toy block unit which may be efficiently and inexpensively manufactured.

In accordance with the invention, a block unit consists of a three-dimensional central hub structure and at least three attachment arms extending outwardly therefrom along non-parallel axes projecting from the central hub. At least one axis projects out of the plane defined by two other axes. The arms are adapted to be connectable to corresponding arms extending from other block units, thus allowing a plurality of block units to be interconnected to form a large variety of three-dimensional structures.

In a particular embodiment of the invention, the central hub structure is a cube, either with or without solid faces. Three attachment arms are provided, each of which extends along an axis projecting from one of three mutually perpendicular and contiguous faces of the cube. Each attachment arm includes a first wall member projecting essentially perpendicularly outward from the face to which it is attached. The outboard end of the first wall member is joined to one end of an inwardly slanting second wall member. The first and second wall members are dimensioned and oriented to create a half-dove tail slot between them and the cube faces from which the first wall member projects. The inward end of the second wall member is joined to the end of a third wall member which extends outwardly from the central hub. The third wall member is positioned parallel to the first wall member and is equal in length to the first wall member.

To connect two block units the block units are oriented so that the first wall member of each is adjacent to the third wall member of the other, and so that the slanted second wall members are also adjacent. The block units are then slid together, so that the second and third wall members of one block unit are supported within the half-dove tail slot of the other block unit.

The above objects and advantages of the invention will be clearly apparent to those skilled in the art from a study of the following detailed description, in connection with the accompanying drawings wherein a preferred embodiment of the invention is disclosed wherein.

Figure 1:
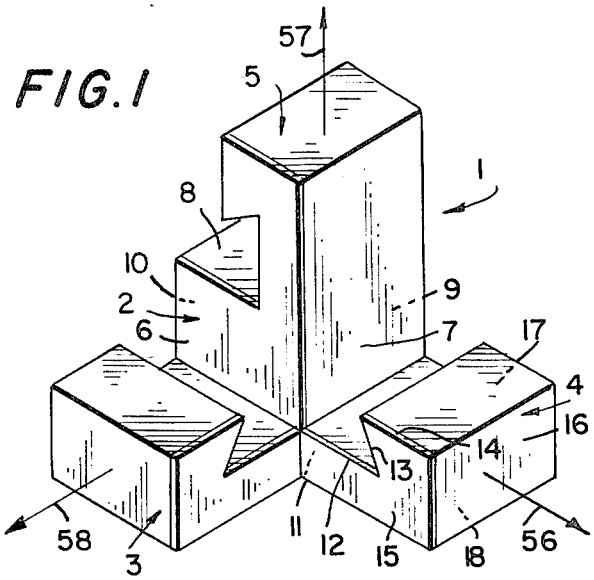
FIG. 1 is a perspective view of a block unit showing the central hub in the form of a cube and three attachment arms extending along axes projecting from three mutually contiguous and perpendicular faces of the cube.
Figure 3:
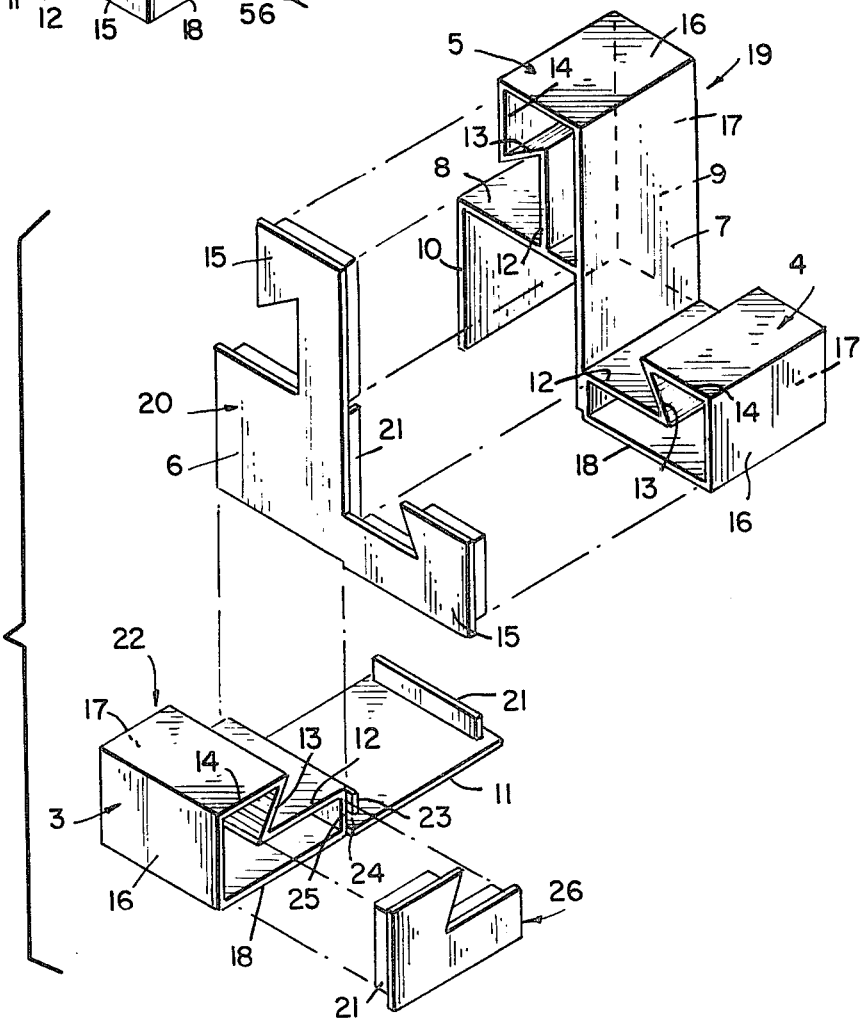
FIG. 3 is a perspective exploded view of the block unit of FIG. 1, showing the component pieces of the block unit prior to assembly.

Referring to FIGS. 1 and 3, block unit 1 consists of central hub structure 2 in the form of a cube with faces 6, 7, 8, 9, 10 and 11, and identical closed attachment arms 3, 4 and 5 projecting from three mutually perpendicular and contiguous cube faces 6, 7 and 8, respectively.

The arms lie along non-parallel axes 56, 57 and 58 which extend from central hub 2. Axes 56 and 57 define a plane and axis 58 projects at an angle of 90° from the plane defined by axes 56 and 57. It is appreciated that if central hub structure 2 is other than a cube, axis 58 can form an angle other than 90° with the plane of the other two axes.

Attachment arm 4, which is typical, includes first wall member 12 extending perpendicularly outward from face 7. Second wall member 13 is joined to the outward end of first wall member 12 and inclines inwardly towards cube face 7. Third wall member 14 is attached to the inward end of second wall member 13, is parallel to first wall member 12, and projects outwardly from cube face 7. Attachment arm side wall members 15 and 17, and attachment arm face member 16 provide structural rigidity for attachment arm 4. Attachment arm base face 18 seals the bottom of the attachment arm to form a closed structure. Attachment arms 3 and 5 are identical to attachment arm 4 and therefore need not be further described.

Figure 2:
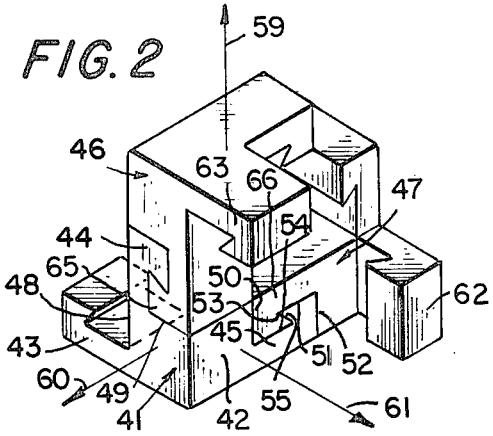
FIG. 2 is a perspective view of a representative structure built by the interconnection of the block units of FIG. 1 showing the means by which adjacent block units are connected.

By reference to FIG. 2, it can be appreciated that the disadvantages of the prior art are overcome by the block units presented in the present invention. Typical block unit 41, representative of the block unit of FIG. 1, contains central cube 42 and attachment arms 43, 44 and 45. Block unit 41 is attached to adjacent block units 46 and 47 to produce a three-dimensional structure. Block units 41 and 46 are connected through their respective attachment arms 44 and 65 lying along axis 59, while block units 41 and 47 are connected through their respective attachment arms 45 and 66 lying along axis 60. It is to be appreciated that if a similar block unit is attached to block unit 41 by use of attachment arm 43, that the line of attachment of these two blocks would be along axis 61. As axes 59, 60 and 61 do not all lie in the same plane, a structure truly utilizing all three dimensions is created.

The block units of FIG. 2 are held in position with respect to one another by the mutual action of the attachment arms with third wall members lying adjacent to the first wall members of the attachment arm to which it is connected. Specifically, referring to the attachment of block unit 42 to block unit 47, third wall member 51 of block unit 42 is secured between cube face 52 and inclined wall member 53 of block unit 47. Similarly, third wall member 54 of block unit 47 is secured between cube face 50 and inclined wall member 55 of block unit 42. By attaching other similar block units to exposed attachment arms such as attachment arms 43, 62 and 63, larger and more complex structures can be constructed.

Block 1 can be constructed of any suitable material, preferably plastic, and can be economically formed from the main body piece, main body face piece, arm piece, and arm side wall piece illustrated in FIG. 3. Main body piece 19 includes central hub structure faces 7, 8, 9 and 10, as well as attachment arms 4 and 5 including first wall members 12, second wall members 13, third wall members 14, and attachment arm face members 16. Main body piece 19 also includes attachment arm side wall members 17 of attachment arms 3 and 4, which lie in the same plane as central hub structure face 9.

Main body face piece 20 contains attachment arm side wall members 15 for attachment arms 4 and 5, as well as face 6 of the central hub structure. The inner face of main body face piece 20 is provided with shoulders 21 so located and dimensioned to produce a friction fit with the inner surface of the section of main body piece 19 to which it is joined.

Arm piece 22 consists of attachment arm 3, its attachment arm face 16, attachment arm side wall member 17, attachment arm base face 18, and face 11 of the central hub structure. Shoulder 21 on this piece is so located and dimensioned to provide a friction fit with the inner surface of face 9 on main body assembly 19. Shoulder 23 is so oriented to form slot 24 between it and attachment arm inner face 25. Slot 24 engages the lower part of central hub structure face 6 on main body face piece 20 in a friction fit upon assembly.

Arm side wall piece 26 seals third attachment piece 22 and is provided with shoulders 21 to provide a friction fit with the inner surface of arm 22.

To assemble the block unit of FIG. 1 from the components of FIG. 3, main body face piece 20 is assembled with main body assembly 19. Arm side wall piece 26 is assembled with arm piece 22, and the resulting subassembly is joined with the completed main body. Additional strength can be obtained by gluing the various members together to form the block unit.

Figure 4:
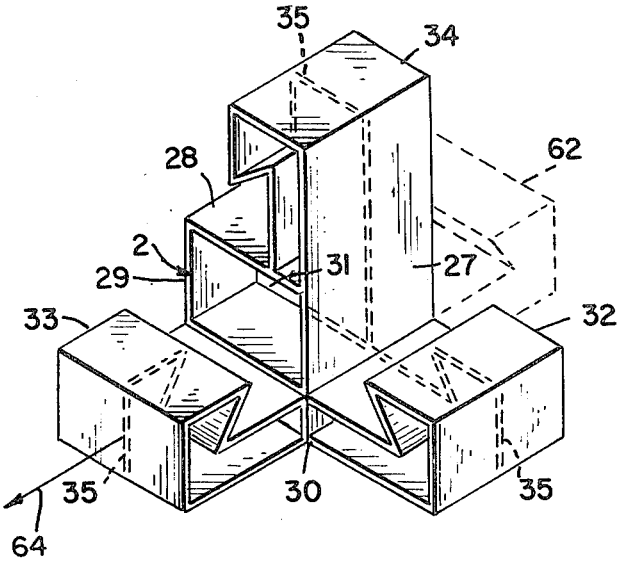
FIG. 4 is a perspective view of an alternate embodiment of a block unit in which cube faces and attachment arm side walls are not used.
Figure 5:
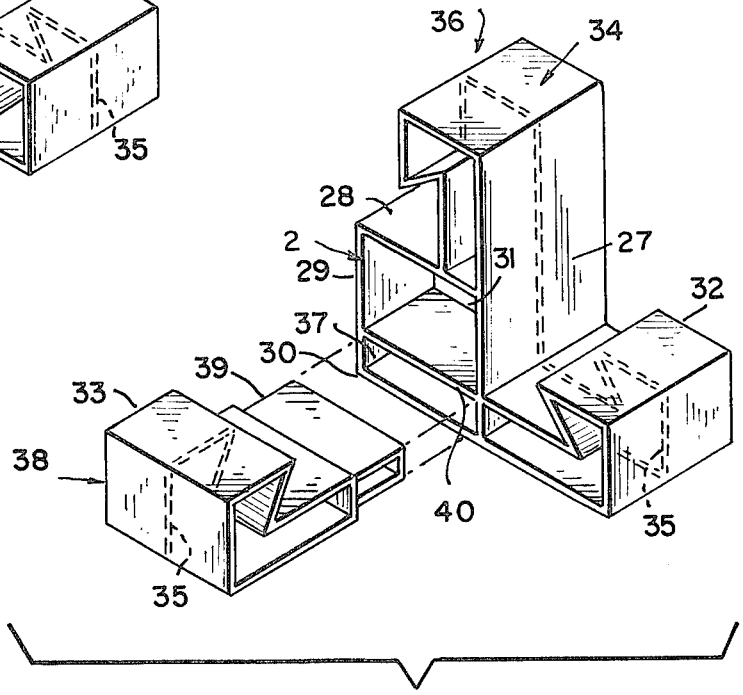
FIG. 5 is an exploded view of the block unit of FIG. 4, showing the component pieces of the block unit piror to assembly.

A block unit of the invention can also be constructed in accordance with the structure of FIGS. 4 and 5. This embodiment is similar to that of FIGS. 1, 2 and 3, with the exception that central hub structure faces 6 and 9 are not present. Also missing are attachment arm side wall members 15 and 17. In their places, the central hub structure and the attachment arms are provided with central walls located equidistant between the open surfaces and parallel to them. The inclusion of these central walls in place of central hub structure and attachment arm faces creates an embodiment especially suited for the inexpensive manufacture of the component pieces for the block unit by injection molding.

FIG. 4 represents a block unit incorporating the central wall configuration. Central hub structure 2 in this embodiment consists of faces 27, 28, 29 and 30, corresponding to faces 7, 8, 10 and 11 in FIG. 1. The cube faces corresponding to cube faces 6 and 9 in FIG. 1 are omitted. Central wall 31 is located equidistant between the two open faces and lies parallel to the open faces, sealing the central hub structure into two chambers, each open on one side. Similarly, attachment arms 32, 33 and 34 lack the attachment arm side wall members 15 and 17 of the previous embodiment, but are provided with attachment arm central walls 35, located equidistant between the open sides and parallel to them.

The block of FIG. 4 can be economically produced from the two parts shown in FIG. 5. Main body piece 36 contains attachment arms 32 and 34 as well as central hub structure 2. Central hub structure 2 is supplied with central wall 31. Attachment arms 32 and 34 are each supplied with a central wall 35. It is to be noted that central wall 31 of central hub structure 2 and central wall 35 of attachment arms 32 and 34 lie in the same plane and define a continuous inner structural support system. Inner structural wall member 40 lies parallel to cube face 30 and defines slot 37 and an equivalent slot on the opposite side of the central wall.

Attachment arm piece 38 consists of attachment arm 33 with central wall 35 and tongue 39, which is so dimensioned to make a friction fit with the inner surface of slot 37. Tongue 39 also contains central wall 35.

To assemble the pieces of FIG. 4 to form the block unit of FIG. 3, all that is needed is to insert tongue 39 in slot 37. This simplicity of construction is a benefit of the block unit of FIG. 3 above those of the block unit of FIG. 1.

It can be appreciated that tongue 39 can be placed either in slot 37 or its equivalent slot on the other side of internal wall 31, in which case a mirror image block with alternate attachment arm assembly 62 instead of attachment arm 33. Since both attachment arm 33 and its alternate attachment arm 62 lie along axis 64 the features of the invention are preserved in either embodiment.

Although the invention has been described as applied to a specific embodiment, it will be clear that many modifications, including but not limited to the use of different materials or methods of construction, can be easily performed within the scope of the invention claimed.

I claim:

1. A block unit designed to interconnect with other blocks to form three-dimensional structures comprising a central hub and at least three identical attachment arms projecting from said central hub, said attachment arms extending outwardly along non-parallel axes projecting from said central hub, at least one of said axes projecting out of a plane defined by two other of said axes, each of said attachment arms comprising a first wall member projecting perpendicularly outward from said face to which it is attached, a second wall member attached to the outboard end of said first wall member, said second wall member being inclined inwardly toward said face to which said first wall member is attached, and a third wall member attached to the inboard end of said second wall member and directed outwardly and oriented parallel to said first wall member, said attachment arms so dimensioned to allow interconnection with an identical attachment means on another block thus allowing a three-dimensional multiblocked structure to be assembled.

2. The block unit of claim 1 in which the central hub includes a plurality of faces, at least two of said faces lying in non-parallel planes and having attachment arms projecting from said faces.

3. The block unit of claim 2 in which the central hub is a cube with one or more open faces and one or more attachment arms have open sides.

4. The block unit of claim 3 in which the central hub and attachment arms include a central wall.

5. The block unit of claim 1 in which the central hub is a cube with solid faces, and the attachment arms have solid side walls, and each of said attachment arms projects from one of three mutually perpendicular and contiguous faces of said central hub.

* * * * *